US010704848B1

(12) United States Patent
Zeider et al.

(10) Patent No.: US 10,704,848 B1
(45) Date of Patent: Jul. 7, 2020

(54) RECEIVER WITH INTEGRAL HINGE FOR FOLDING BUFFER EXTENSION AND BUTT STOCK ASSEMBLY

(71) Applicant: Shield Development Group, LLC, Bigfork, MT (US)

(72) Inventors: Brandon Michael Zeider, Bigfork, MT (US); Seth Martin Berglee, Joliet, MT (US); Michael Anthony Hebert, Kalispell, MT (US); Raymond Dean Brandly, Oklahoma City, OK (US); Eric Kyle Squires, Yukon, OK (US)

(73) Assignee: Shield Development Group, LLC, Bigfork, MT (US)

( * ) Notice: Subject to any disclaimer, the term of this patent is extended or adjusted under 35 U.S.C. 154(b) by 0 days.

(21) Appl. No.: 16/444,403

(22) Filed: Jun. 18, 2019

Related U.S. Application Data

(60) Provisional application No. 62/686,260, filed on Jun. 18, 2018.

(51) Int. Cl.
*F41C 23/04* (2006.01)
*F41A 3/66* (2006.01)
*F41A 3/84* (2006.01)

(52) U.S. Cl.
CPC *F41A 3/66* (2013.01); *F41A 3/84* (2013.01); *F41C 23/04* (2013.01)

(58) Field of Classification Search
CPC ..... F41C 23/04; F41C 23/14; F41C 23/20
See application file for complete search history.

(56) References Cited

U.S. PATENT DOCUMENTS

| | | | | |
|---|---|---|---|---|
| 7,966,761 | B1 | 6/2011 | Kuczynko et al. | |
| 8,245,429 | B2 | 8/2012 | Kuczynko et al. | |
| 8,631,601 | B2 | 1/2014 | Langevin et al. | |
| 8,656,623 | B1 | 2/2014 | Chvala | |
| 8,769,855 | B2 | 7/2014 | Law | |
| 8,991,088 | B1 | 3/2015 | Young | |
| 9,121,663 | B2 | 9/2015 | Troy et al. | |
| 9,347,738 | B1 | 5/2016 | Schumacher | |
| 9,546,895 | B2 | 1/2017 | Flasza et al. | |
| 9,719,754 | B2 | 8/2017 | Law | |
| 2011/0131857 | A1* | 6/2011 | Kuczynko | F41A 3/84 42/73 |

(Continued)

*Primary Examiner* — J. Woodrow Eldred
(74) *Attorney, Agent, or Firm* — Wood Herron & Evans LLP

(57) ABSTRACT

Provided is a firearm lower receiver configured to mate with an AR-pattern, auto-loading upper receiver assembly. The lower receiver has a body and a hinge mechanism having a fixed part integral to the lower receiver body and a moving part to which a buffer tube is mounted. The hinge is movable between an extended, operating position where the buffer tube is substantially aligned with the bolt carrier and a folded position. The fixed part includes a carrier blocking member movable between a blocking position where the blocking member prevents rearward movement of a bolt carrier in the upper receiver and a displaced position. The blocking member is spring biased toward the blocking position. A striker extends from the moving part and is configured to contact the carrier blocking member and move it against the spring bias to the displaced position when the hinge mechanism is in the extended, operating position.

4 Claims, 10 Drawing Sheets

(56) References Cited

U.S. PATENT DOCUMENTS

| | | | | |
|---|---|---|---|---|
| 2012/0137562 | A1* | 6/2012 | Langevin | F41C 23/14<br>42/75.03 |
| 2012/0137652 | A1 | 6/2012 | Asprey et al. | |
| 2013/0212920 | A1* | 8/2013 | Law | F41C 23/14<br>42/75.03 |
| 2014/0190056 | A1 | 7/2014 | Troy et al. | |
| 2015/0345895 | A1 | 12/2015 | Young | |
| 2017/0328673 | A1 | 11/2017 | Law | |

* cited by examiner

RECEIVER WITH INTEGRAL HINGE FOR FOLDING BUFFER EXTENSION AND BUTT STOCK ASSEMBLY

RELATED APPLICATIONS

This application claims priority to U.S. Provisional Patent Application No. 62/686,260, filed Jun. 18, 2018, and incorporates the same herein by reference.

TECHNICAL FIELD

This invention relates to a firearm receiver having an integral hinge that allows folding of the receiver extension or buffer tube/butt stock in a more compact package than provided by a separate adapter device for the same purpose.

BACKGROUND

Several spaced-saving advantages are achieved by being able to fold the butt stock of a rifle relative to its receiver and barrel. For semiautomatic and automatic rifle deigns where the entire action, including the recoil spring/buffer system, is housed within the receiver, this merely requires providing a hinged attachment for the butt stock. However, in rifle designs, such as many AR-pattern firearms, where the bolt or the bolt carrier reciprocates into a receiver extension housed within or part of the butt stock where a recoil spring and/or buffer are located, this is more complicated.

Others have addressed this issue by providing a shortened receiver extension behind which the butt stock may be hinged to fold. Examples are shown in U.S. Pat. Nos. 7,966,761 and 9,347,738. This solution, however, fails to maximize the space-saving benefits of folding the butt stock. Others have used an adapter that provides a hinge with a fixed portion that is secured to the lower receiver and a pivoting portion that carries the buffer tube/butt stock assembly. Examples are shown in U.S. Pat. Nos. 8,769,855 and 8,991,088. Such adaptors add undesired weight and length to the extended butt stock.

SUMMARY OF THE INVENTION

The present invention provides a firearm receiver, such as the lower receiver of an AR-pattern rifle, with an integral hinge that allows folding of the buffer tube/butt stock assembly without significant added length or weight. Any standard upper receiver assembly, including any standard bolt carrier group, can be used without modification. Likewise, any standard buffer tube/butt stock assembly can be used, with substitution of only an inexpensive, modified recoil buffer.

A firearm lower receiver is configured to mate with an AR-pattern, auto-loading upper receiver assembly. The lower receiver includes a lower receiver body. A hinge mechanism has a fixed part integral to the lower receiver body and has a moving part to which a buffer tube is mounted. The hinge is movable between an extended, operating position where the buffer tube is substantially aligned with the bolt carrier and a folded position. The fixed part includes a carrier blocking member movable between a blocking position where the blocking member prevents rearward movement of a bolt carrier in the upper receiver and a displaced position where the blocking member does not interfere with movement of the bolt carrier, the blocking member being spring biased toward the blocking position. A striker extends from the moving part and is configured to contact the carrier blocking member and move it against the spring bias to the displaced position when the hinge mechanism is in the extended, operating position.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
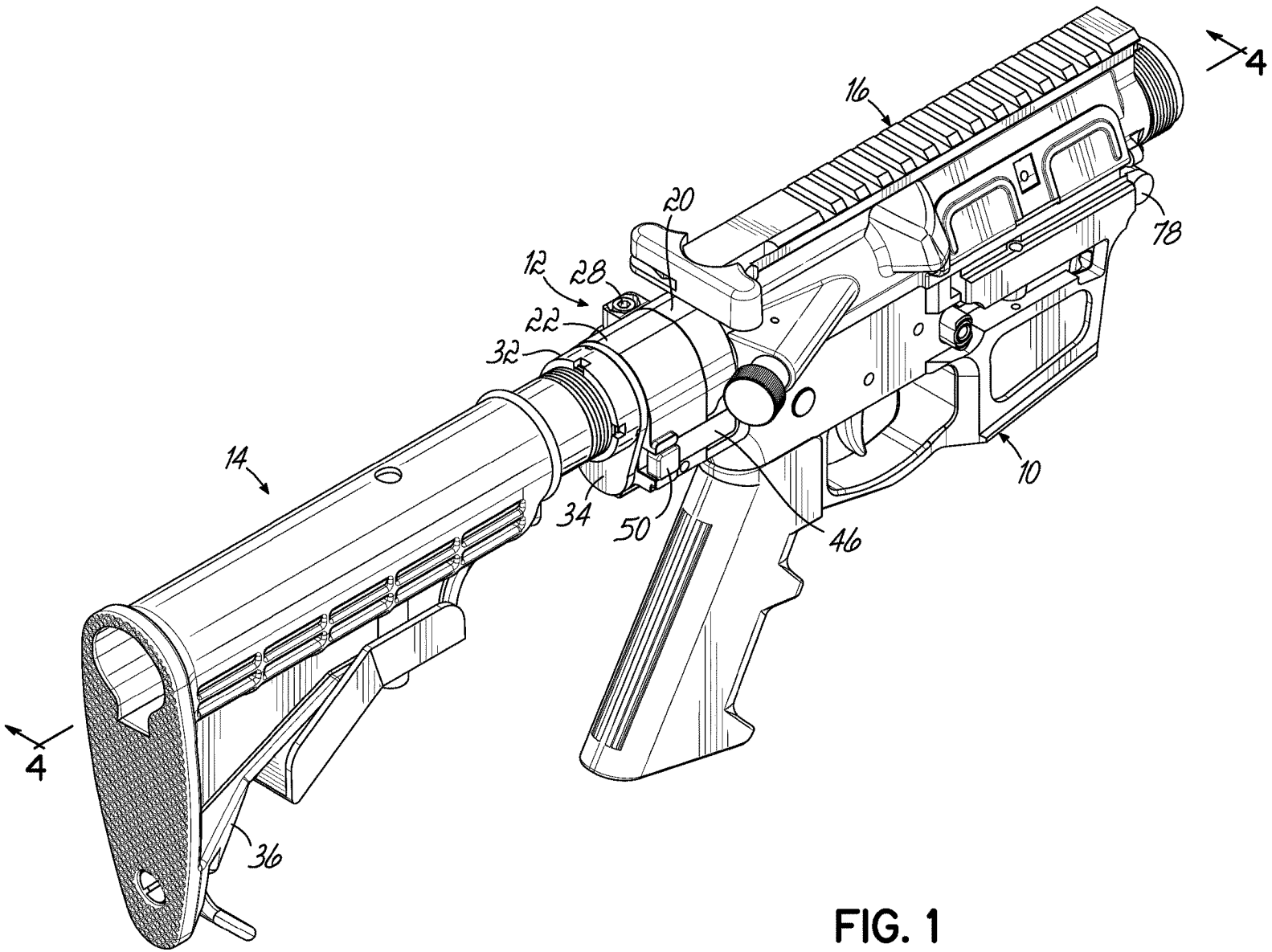
FIG. 1 is an isometric view of an AR-pattern firearm receiver according to one embodiment of the present invention with the buffer tube extension in an extended position.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
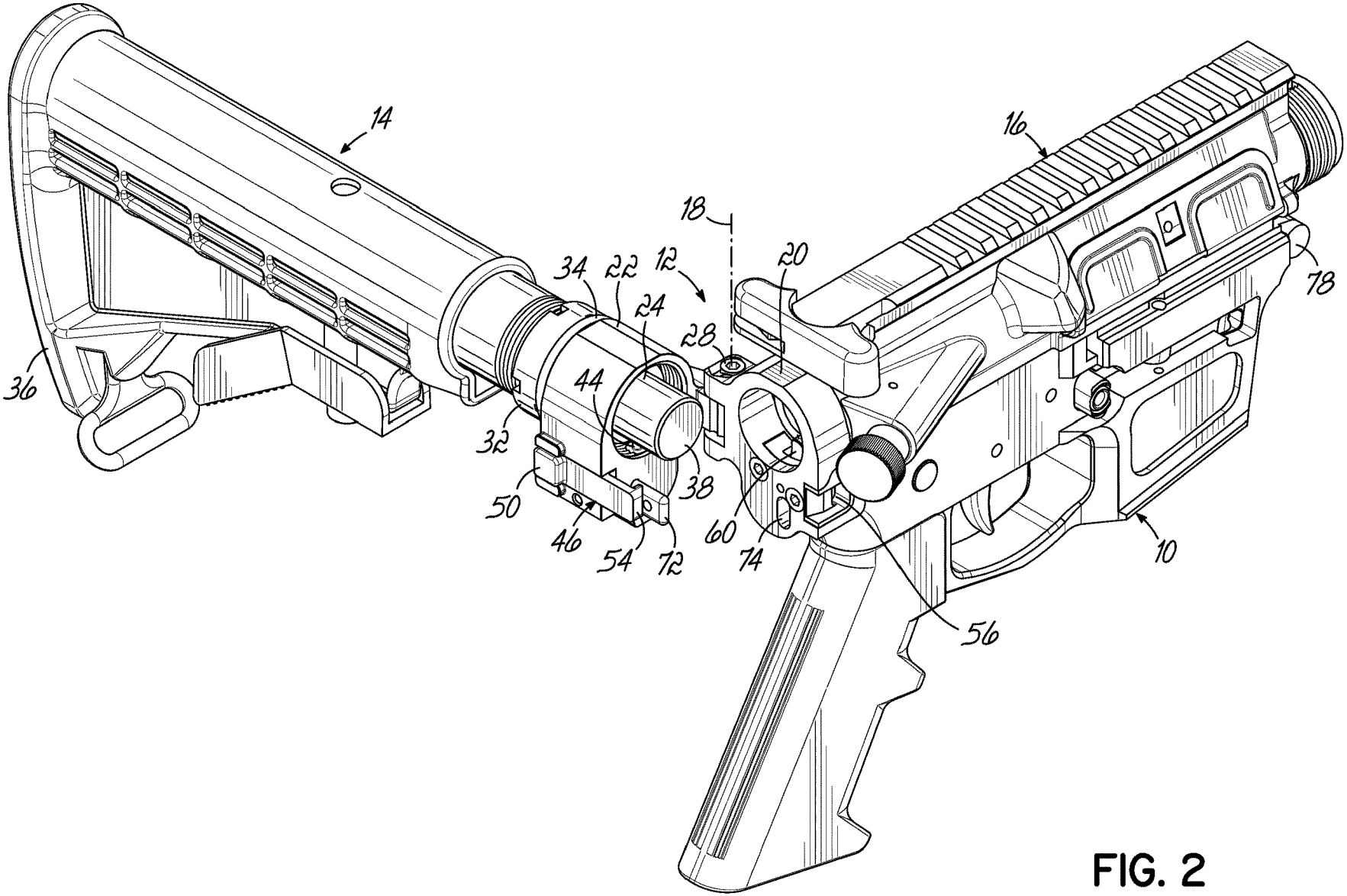
FIG. 2 is another isometric view thereof with the buffer tube extension in a partially folded position.
Figure 3:
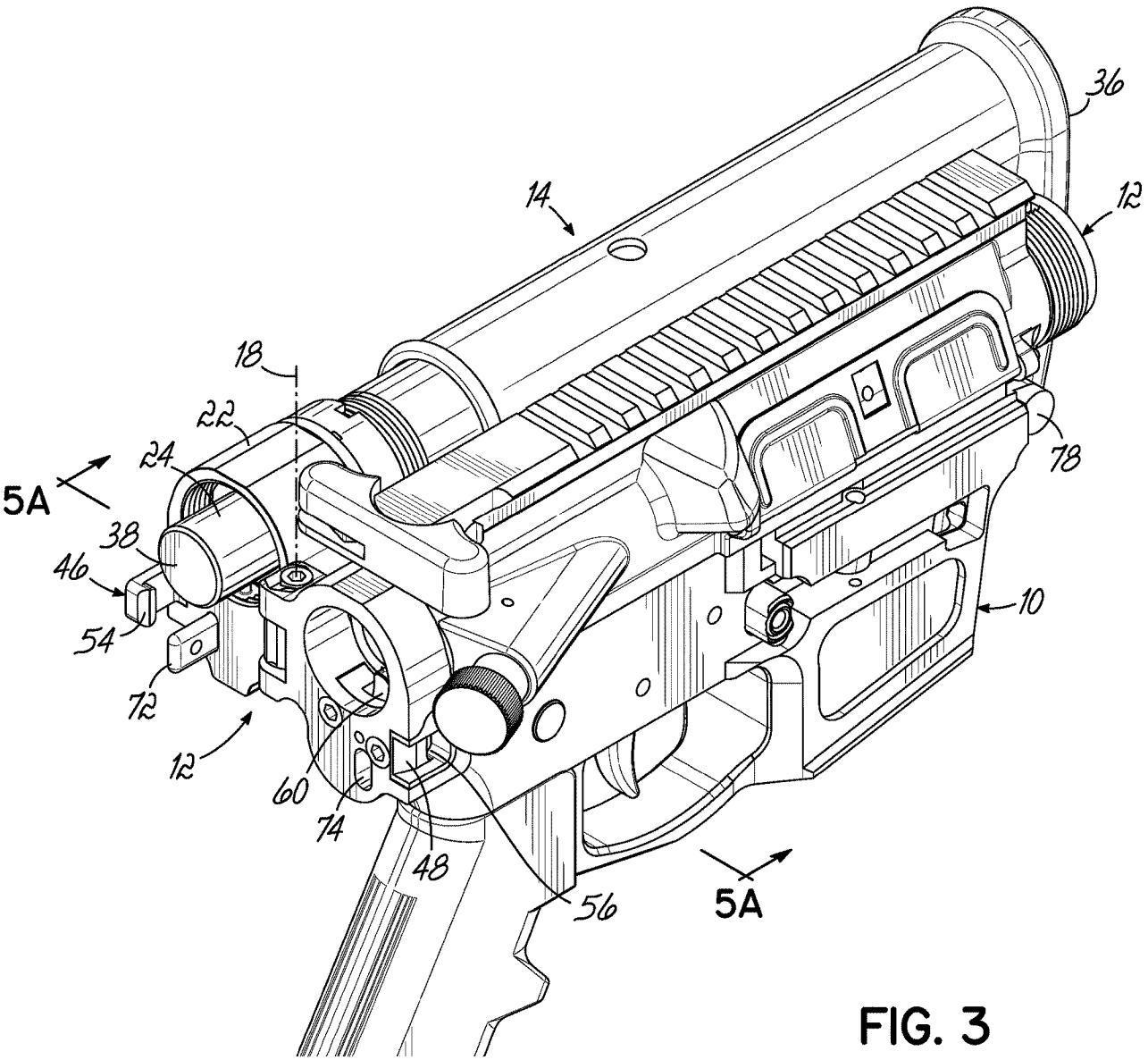
FIG. 3 is another isometric view with the buffer tube extension in a fully folded position.

An AR-pattern firearm is an auto-loading weapon system in common use that uses a receiver extension to house a buffer/recoil spring. An AR-pattern lower receiver will mate with an AR-pattern upper receiver assembly according to standard specifications. Thus, an AR-pattern lower receiver, adapted according to an embodiment of the present invention, is illustrated and described herein. Referring first to FIGS. 1-3, therein is shown an AR-pattern firearm lower receiver 10 according to an embodiment of the present invention. As used herein, an "AR-pattern" lower receiver is inclusive of any of the family of AR15, AR10, M16, M4, and other variants, including pistol caliber carbines. An AR-pattern lower receiver can interchangeably accept upper receiver assemblies of multiple calibers and types. Likewise, the AR-pattern upper receiver may accept and use gas-operated bolt carrier assemblies that may be either direct impingement or gas piston, and blow-back bolts or bolt carrier assemblies (particularly in the case of pistol-caliber carbines). In the illustrated embodiment, the lower receiver 10 maintains this modularity and ability to accept various types and calibers of upper receiver assemblies.

The lower receiver 10 includes a novel integral hinge 12 that allows the buffer tube/butt stock assembly 14 to be folded to the side relative to the lower receiver 10 and upper receiver 16. As illustrated in FIGS. 2 and 3, the hinge 12 pivots about a substantially vertical pivot axis 18 which may be off-set laterally to either side relative to the upper and lower receivers 10, 16. In the illustrated embodiment, the axis 18 is off-set to the left and the hinge 12 folds to the left. The hinge 12 includes a first portion 20 integral to the lower receiver 10 that houses a latching feature and a bolt carrier blocking feature (both described in greater detail below). The longitudinal dimension (along an axis substantially parallel to the barrel and direction of reciprocation of the action) of the first portion 20 is kept to a minimum to minimize the overall folded length. A second portion 22 of the hinge 12 carries the buffer tube/butt stock assembly 14, along with a buffer 24 and recoil spring 26 housed therein. The first and second portions 20, 22 of the hinge 12 are pivotally connected together at a knuckle, such as by a pivot pin 28 that may be secured by a threaded engagement (not shown) in the first portion 20 or a nut 29. As shown, the pivot axis 18 may be positioned axially forward relative to the interface between the first portion 20 and second portion 22 to minimize the overall length when folded.

Figure 4:
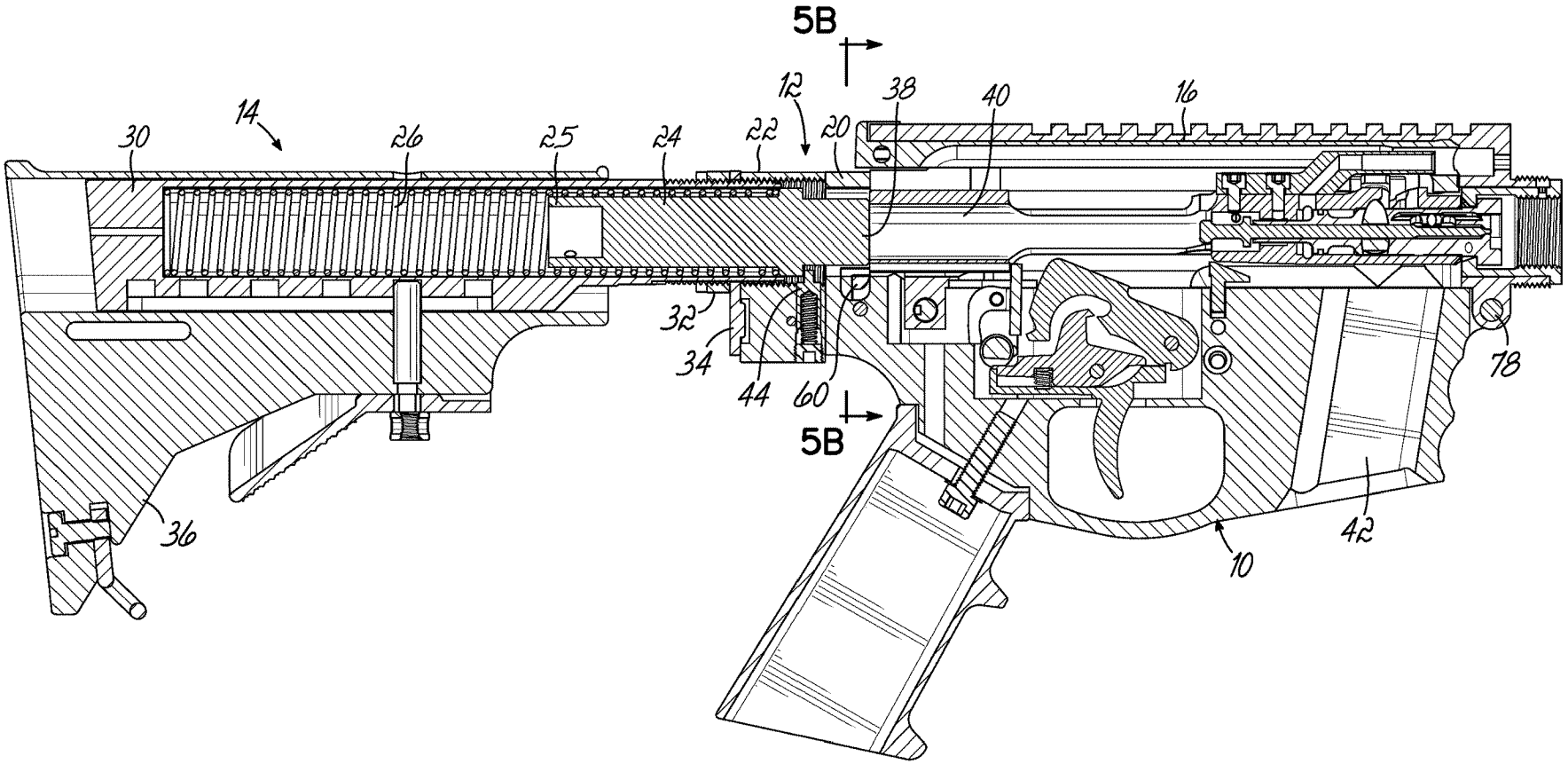
FIG. 4 is a side sectional view taken substantially along line 4-4 of FIG. 1.
Figure 5A:
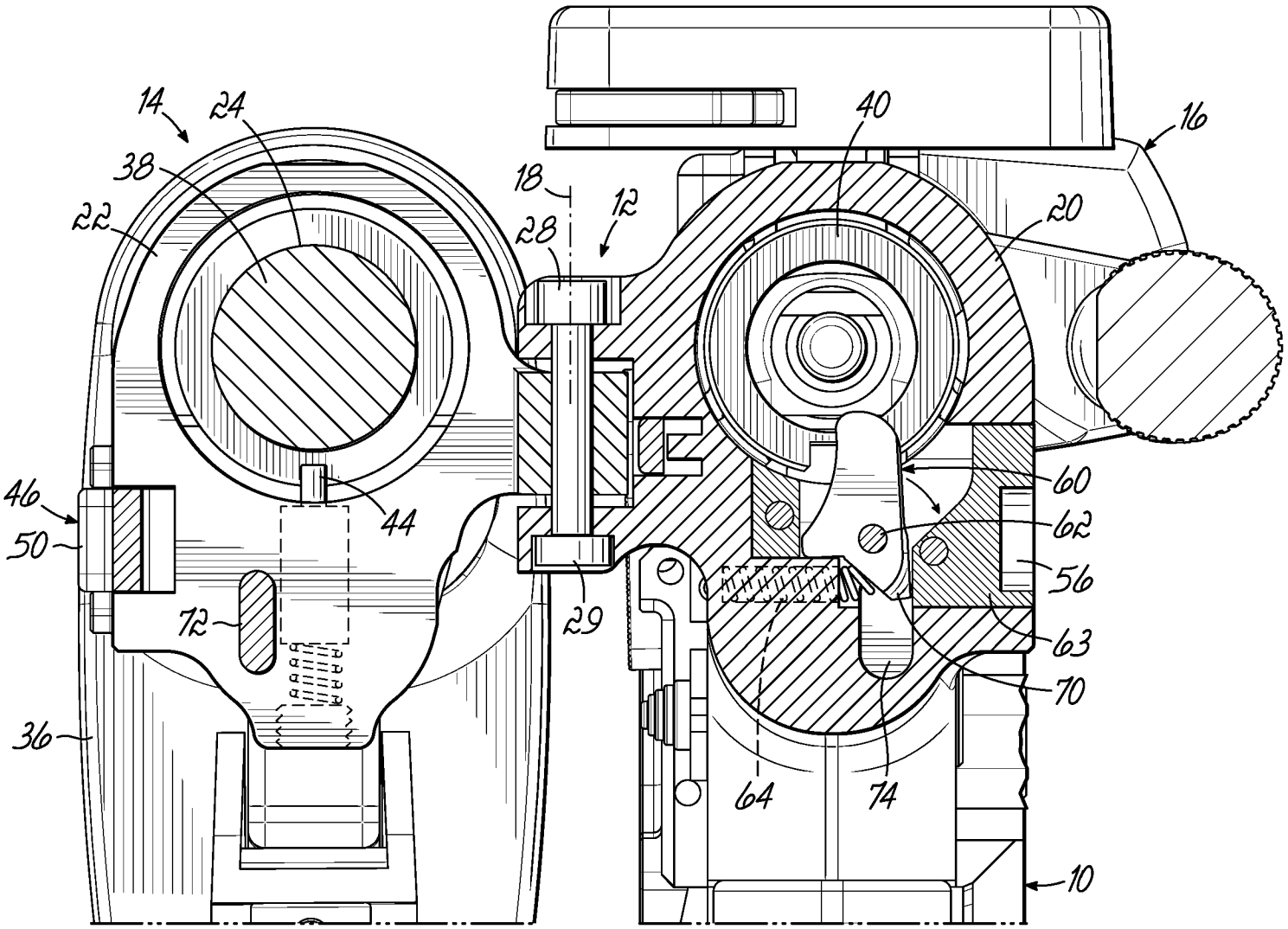
FIG. 5A is sectional view taken substantially along line 5A-5A of FIG. 3.
Figure 5B:
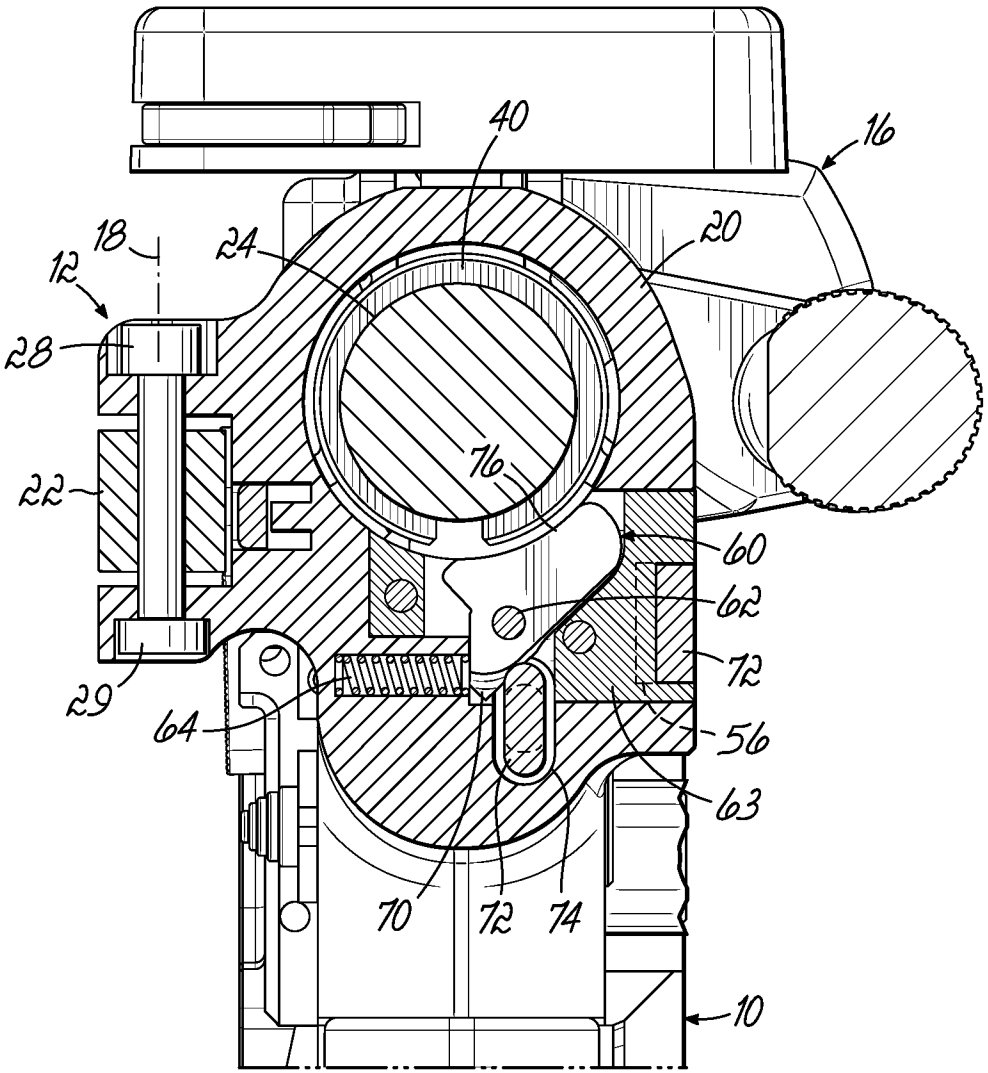
FIG. 5B is a cross-sectional view taken substantially along line 5B-5B of FIG. 4.
Figure 6A:
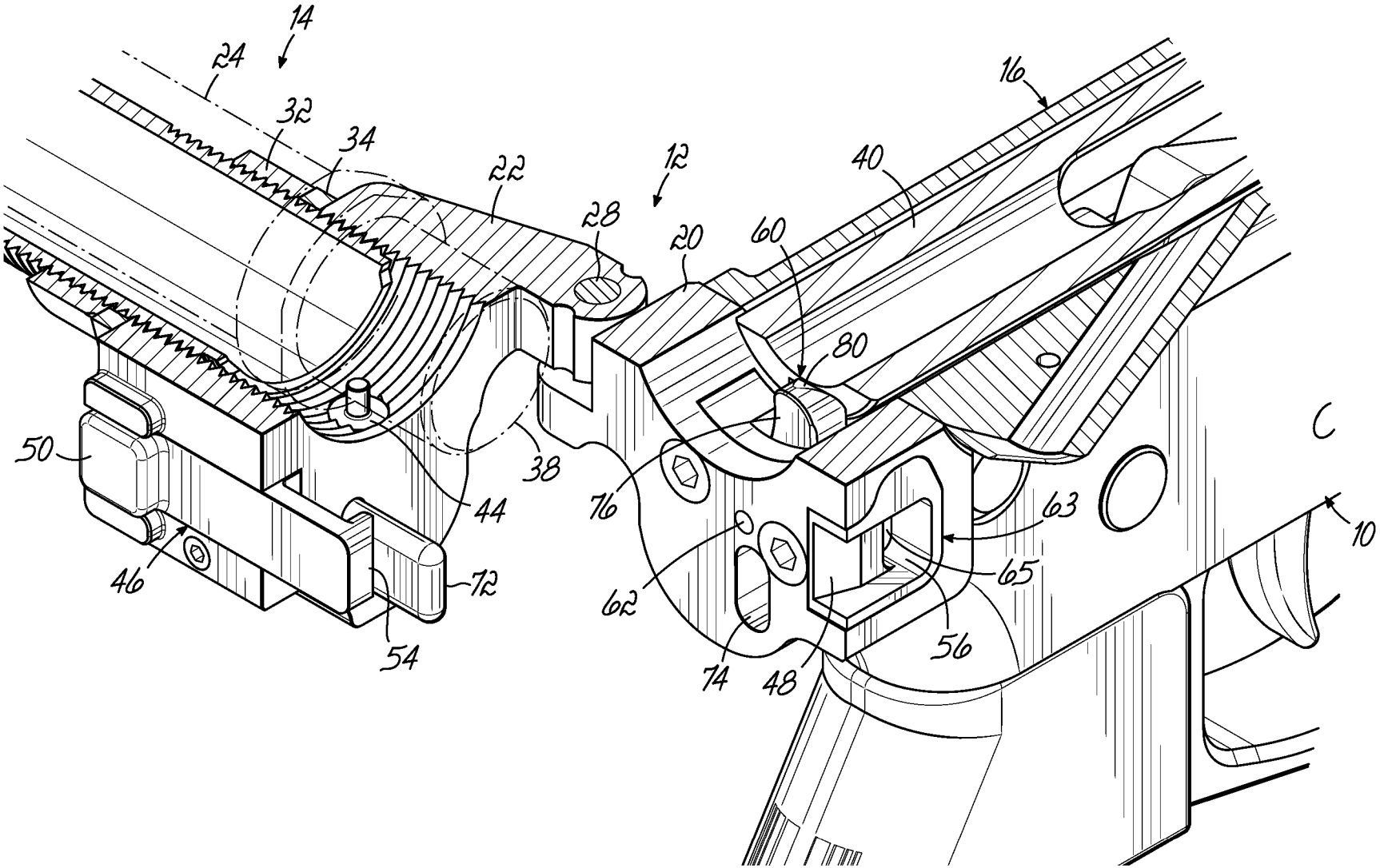
FIG. 6A is an enlarged, fragmentary, partially cut-away isometric view with the buffer tube extension in a partially folded position.
Figure 6B:
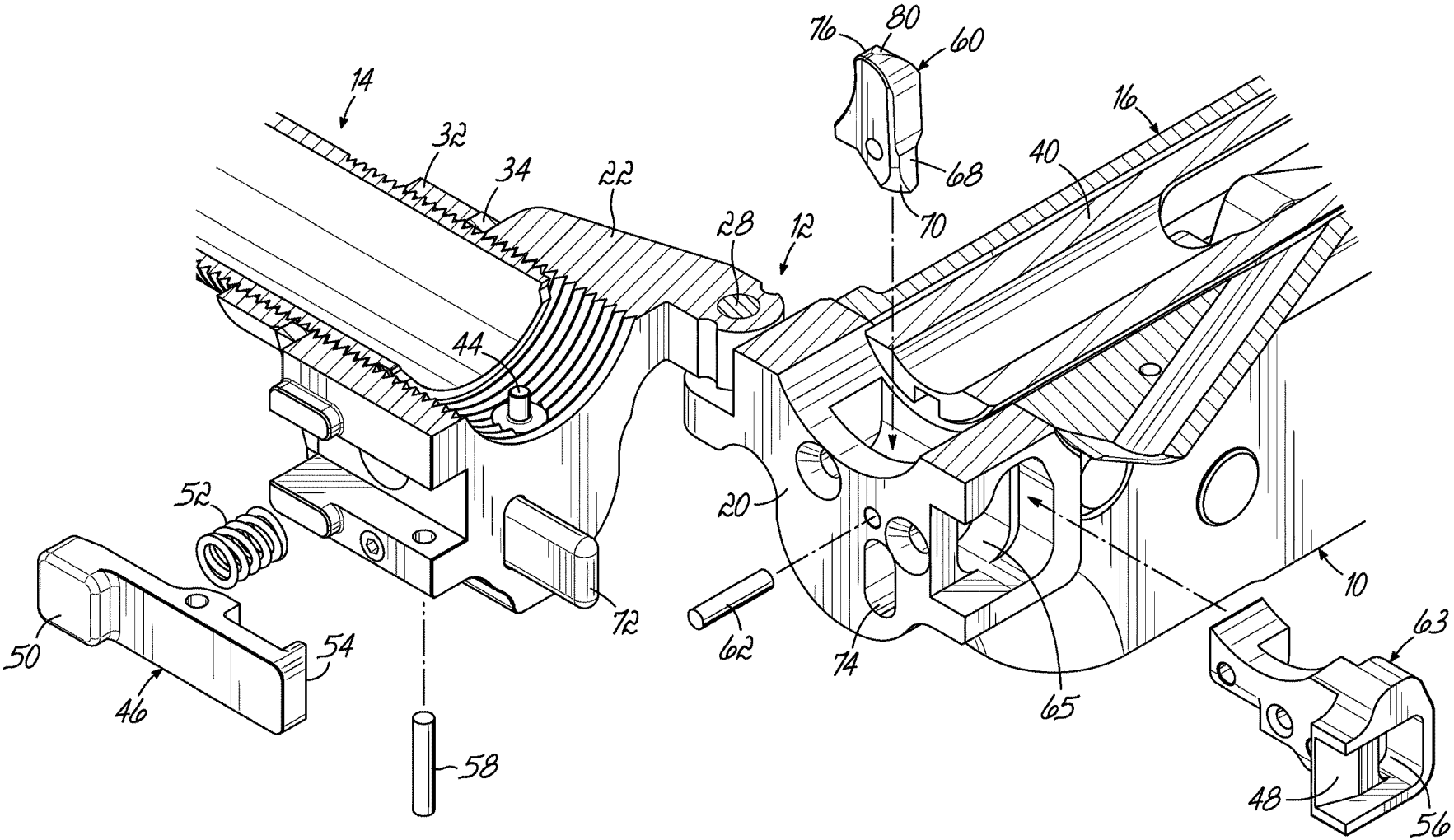
FIG. 6B is an exploded view thereof.

Referring now also to FIG. 4, the buffer tube/butt stock assembly 14 includes an otherwise ordinary receiver extension or buffer tube 30 that is attached by threaded engagement to the second portion 22 of the hinge 12 using a castle nut 32 and an end plate 34 (in the common and well-known manner). In the illustrated embodiment, an adjustable (telescoping) butt stock 36 is mounted to the buffer tube 30. The particular type of butt stock is not important to the present invention and can be fixed or eliminated entirely (for a pistol arm brace configuration).

The buffer 24 includes a forward extension portion 38, but it is otherwise ordinary in its design and construction to provide a moving mass that compresses the recoil spring 26 within the buffer tube 30 when the bolt carrier 40 (housed within the upper receiver 16) reciprocates to the rear during cycling of the action. The buffer 24 may include a resilient end cap 25 and internal chamber to house selected weights (not shown). Referring specifically to FIGS. 4, 5A, 6A, and 6B, the second portion 22 of the hinge 12 also includes a spring-biased buffer-retaining detent 44, which functions like that found in a standard AR-pattern lower receiver, but it is located in the pivoting second portion 22 of the hinge 12 in this embodiment of the present invention.

The lower receiver 10 houses a fire control group (shown in FIG. 4) and a magazine well 42 configured to receive an ammunition magazine. The illustrated magazine well 42 is adapted to receive a pistol caliber ammunition magazine, but it may be configured to receive the common AR15 (5.56 mm, 300BLK) or a AR10 (7.62 mm) ammunition magazines.

Referring now in particular to FIGS. 5A-B, 6A-B, and 7A-B, the illustrated embodiment includes an automatic latching mechanism and an automatic bolt carrier retention mechanism, each of which are described below. In the illustrated embodiment, the automatic latch mechanism includes a latch lever 46 which is pivotally mounted on and extends from the second portion 22 of the hinge 12 toward the first portion 20 and, when moved to the closed position, it is deflected against the force of a spring 52 by a cam surface 48 in the first portion 20 of the hinge 12 and a pawl 54 is biased by the spring to latch into a latch socket 56. The latch lever 46 pivots on a pin 58 and includes a release button 50 that, when pressed, pivots the lever 46 to disengage the pawl 54 from the latch socket 56 on the first portion 20.

The first portion 20 of the hinge 12 also carries a pivotally mounted bolt carrier blocking member 60, which retains the bolt carrier 40 in place when the hinge 12 is unlatched in a partially or fully open/folded position. The blocking member 60 pivots on a pin 62 carried by the first portion 20 and an assembly frame 63. The assembly frame 63 can be a separate piece (as shown) that fits into a socket 65 in the first portion 20 for ease of manufacture and assembly. The blocking member can swing, for example, about 45° of rotation between a blocking position (FIGS. 2, 3, 5A, 6A, 7A, and 7B), when the hinge 12 is open, and a displaced position (FIGS. 5B and 7C), when the hinge is completely closed.

Figure 7A:
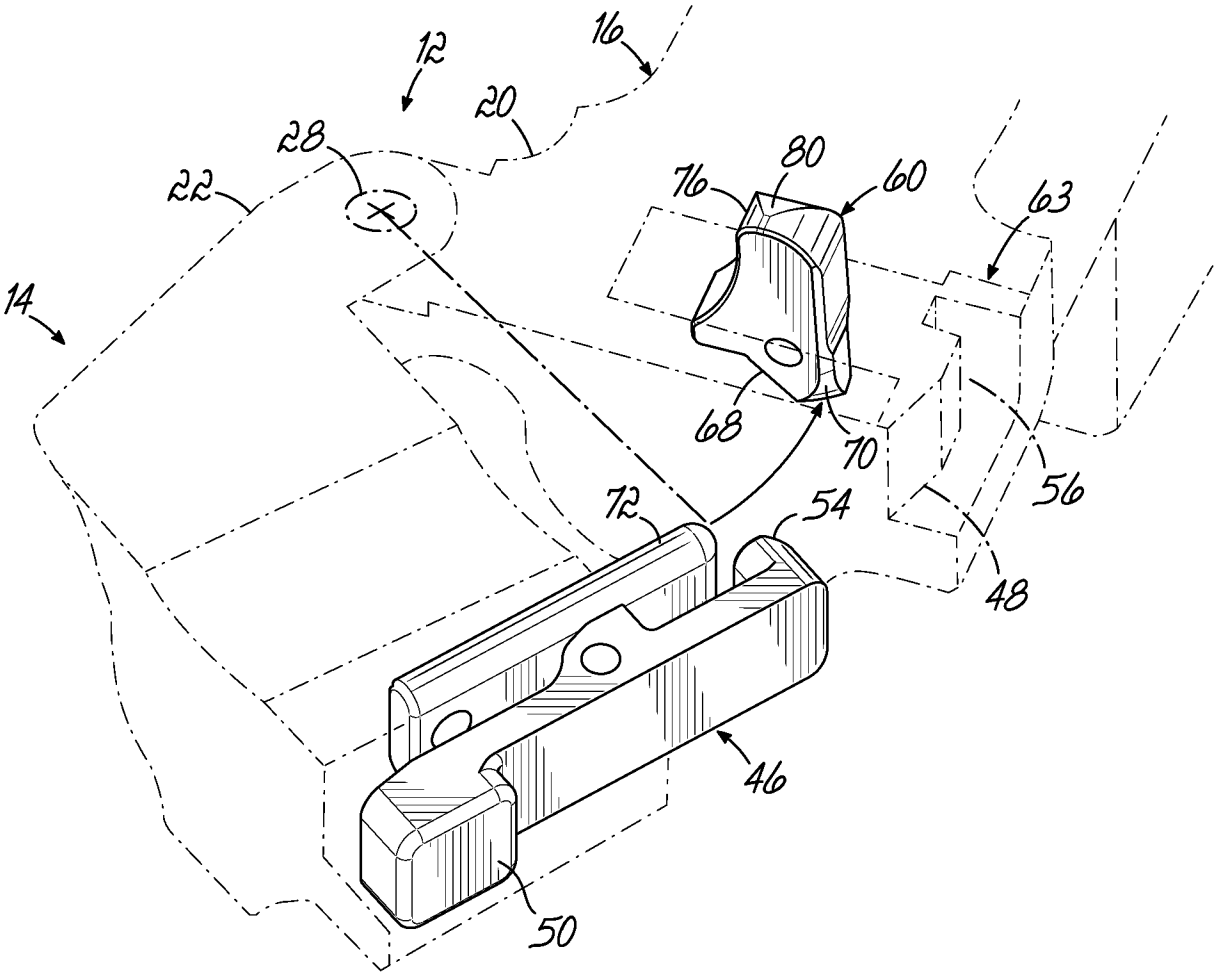
FIG. 7A is an enlarged isometric view of internal components in an unlatched position.
Figure 7C:
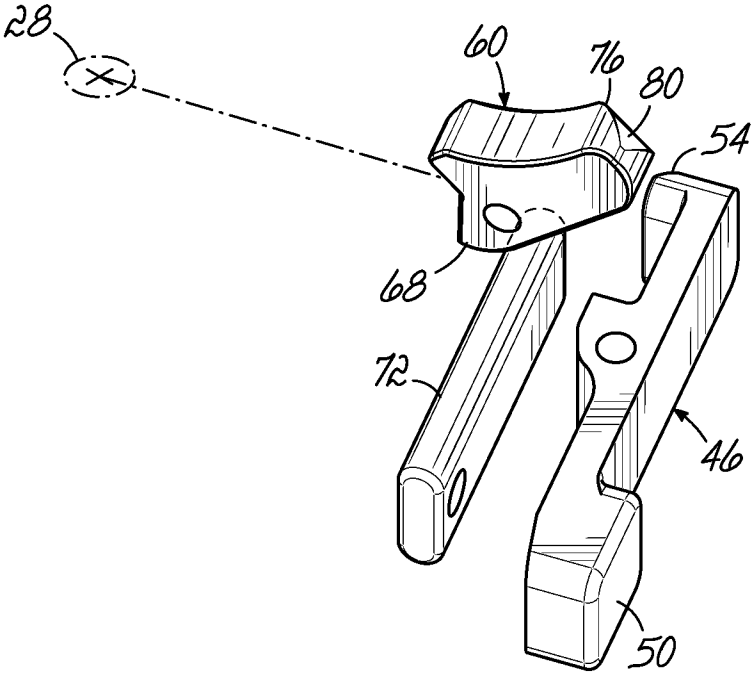
FIG. 7C is a similar view showing the striker and carrier blocking member fully engaged.
Figure 7B:
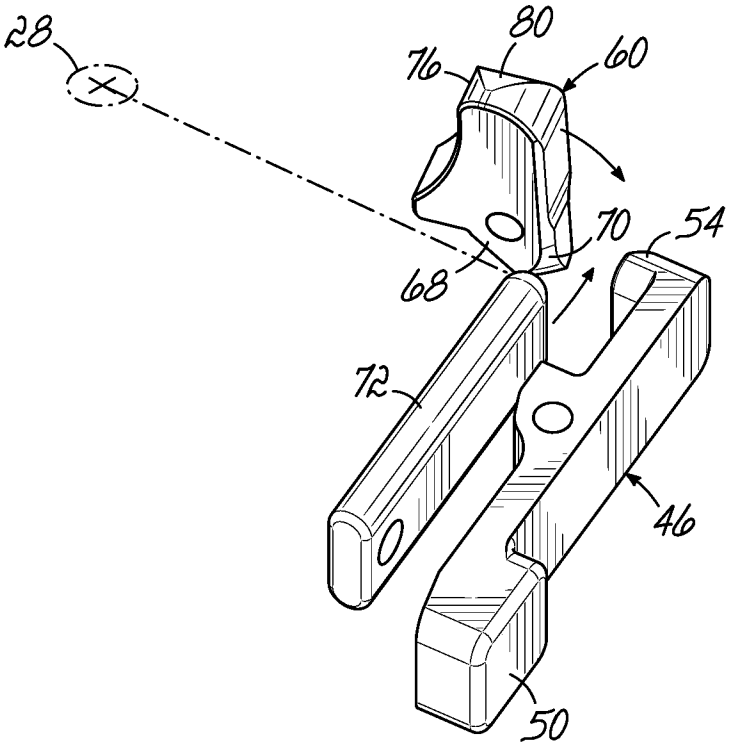
FIG. 7B is a similar view showing the striker and carrier blocking member partially engaged.

Referring now also to FIGS. 7A-C, the blocking member 60 acts as a swing arm with a lower portion 68 being biased by a spring 64 toward the blocking position. A striker 72 in the form of a tongue or blade carried by the second portion 22 passes into a socket 74 in the first portion 20 and the assembly frame 63 to contact a chamfered edge 70 that provides a cam surface on the lower portion 68 of the carrier blocking member 60. When displaced by the striker 72, an upper portion 76 swings (against the bias of the spring 64) to the displaced position (FIGS. 5B and 7C) into a cavity 66 formed in the first portion 20 and assembly frame 63. The upper portion 76 of the blocking member 60 may be configured to assure clearance by the blot carrier 40 when the hinge 12 is latched and the bolt carrier 40 cycles against the buffer 24 and recoil spring 26.

Referring now in particular to FIGS. 7A-C, therein is shown in isolation the striker 72 and bolt carrier blocking member 60 in a series of positions. FIG. 7C shows the striker 72 seated in the socket 74 and displacing the blocking member 60. The striker 72 has confronted the chamfered edge 70 of the lower end 68 of the bolt carrier blocking member 60 to rotate it about the pivot pin 62 to its displaced position.

As shown in FIGS. 2, 3, 5A, 6A, 7A, and 7B, when the hinge 12 is in a partially or fully folded position, the bolt carrier 40 is blocked in place in the upper receiver 16 by the blocking member 60 and the buffer 24 is retained in the buffer tube 30 against the recoil spring 26 by the spring-biased buffer retaining detent 44. When the hinge 12 is closed/latched in position to fully extend the buffer tube/butt stock assembly 14 (FIGS. 1, 4, and 5B), the bolt carrier 40 is free to reciprocate rearwardly against the extension portion 38 of the buffer 24, compressing the recoil spring 26 within the buffer tube 30. As is well-known in the art, the standard bolt carrier 40 includes a slot 72 in the lower edge of its rear portion that allows it to pass unimpeded over the buffer retaining detent 44. The extension portion 38 of the buffer 24 compensates for the slight increase in spacing without modification of the bolt carrier 40. As is well-known in the art, the upper receiver 16 an AR-pattern firearm can be partially detached from the lower receiver 10 on a pivot assembly pin 78. As the receivers 10, 16 are pivoted together, if the bolt carrier 40 is slightly rearwardly displaced, it could contact the carrier blocking member 60. In order to guide the parts together into place, a forward surface of the upper portion 76 of the blocking member 60 could be formed with a cam surface 80.

To unlatch and fold the buffer tube/butt stock assembly 14, the user presses on the release button 50 of the latch lever 46, pivoting the latch lever 46 against the bias of the spring 52. This displaces the pawl 54 from the latch socket 56 and allows the second portion 22 of the hinge and the buffer tube/butt stock assembly 14 to swing away from the first portion 20 at the substantially vertical pivot axis 18. If desired, the pivot axis 18 may be skewed to cause the buffer tube/butt stock assembly 14 to angle downward slightly when folded so as to avoid interfering with controls on the receivers 10, 16. As the striker 72 withdraws from the socket 74 a minimal distance, the carrier blocking member is biased by the spring 64 to pivot to the blocking position.

To close/extend the buffer tube/butt stock assembly 14, it is swung toward the closed position manually. As it nears the fully extended position (FIGS. 7A and 7B), the striker 72 enters the socket 74 and approaches contact with the chamfered edge 70 of the lower portion 68 of the carrier blocking member 60. At about the same time, the pawl 54 of the latch lever 46 contacts the cam surface 48, causing the lever 46 to pivot on its pivot pin 58 against the spring 52. When the hinge 12 is fully closed, the striker rotates the carrier blocking member 60 to the displaced position (FIG. 7C) and the pawl 54 of the latch lever 46 snaps into the latch socket 56, locking the hinge 12 in the closed position.

Accordingly, the hinge 12 of the present invention allows the buffer tube/butt stock assembly 14 to be quickly and easily folded by depressing a single release button 50. The bolt carrier 40 is automatically and securely retained within the receiver 10, 16, and the buffer 24 is automatically retained within the buffer tube 30. By simply swinging the buffer tube/butt stock assembly 14 back to the extended position, the hinge 12 is automatically latched in the closed position and the bolt carrier 40 automatically freed to reciprocate rearwardly into the receiver extension (buffer tube 30).

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A firearm lower receiver configured to mate with an AR-pattern, auto-loading upper receiver assembly, comprising:

a lower receiver body; and a hinge mechanism having a fixed part integral to the lower receiver body and having a moving part to which a buffer tube is mounted, the hinge movable between an extended, operating position where the buffer tube is substantially aligned with the bolt carrier and a folded position;

the fixed part including a carrier blocking member movable between a blocking position where the blocking member prevents rearward movement of a bolt carrier in the upper receiver and a displaced position where the blocking member does not interfere with movement of the bolt carrier, the blocking member being spring biased toward the blocking position;

a striker extending from the moving part and configured to contact the carrier blocking member and move it against the spring bias to the displaced position when the hinge mechanism is in the extended, operating position.

2. The firearm lower receiver of claim 1, wherein the buffer tube includes a recoil spring and recoil buffer, the recoil buffer including an extension portion configured to engage the bolt carrier when the hinge is in the extended, operating position.

3. The firearm lower receiver of claim 1, wherein the hinge mechanism further comprises a spring latch that automatically engages when the hinge is in the extended, operating position and that may be manually displaced to disengage the spring latch and allow movement to the folded position.

4. The firearm lower receiver of claim 1, wherein the buffer tube includes a recoil spring and recoil buffer and the moving part includes a recoil buffer detent to prevent forward movement of the buffer when the hinge mechanism is in the extended, operating position.

* * * * *